US008443782B2

(12) United States Patent
Ishihara et al.

(10) Patent No.: US 8,443,782 B2
(45) Date of Patent: May 21, 2013

(54) AIR INTAKE APPARATUS FOR INTERNAL COMBUSTION ENGINE

(75) Inventors: Hiromitsu Ishihara, Okazaki (JP); Motonobu Hasegawa, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 604 days.

(21) Appl. No.: 12/487,052

(22) Filed: Jun. 18, 2009

(65) Prior Publication Data

US 2009/0314242 A1 Dec. 24, 2009

(30) Foreign Application Priority Data

Jun. 23, 2008 (JP) ..... 2008-162961

(51) Int. Cl.
*F02D 9/10* (2006.01)

(52) U.S. Cl.
USPC ..... 123/336; 123/184.21; 123/337

(58) Field of Classification Search
USPC ..... 123/184.56, 190.1, 336, 337, 184.53, 123/184.61; 251/305, 308
See application file for complete search history.

(56) References Cited

U.S. PATENT DOCUMENTS

| | | | | |
|---|---|---|---|---|
| 6,427,975 | B1 | 8/2002 | Powell | |
| 7,121,246 | B2 * | 10/2006 | Uchiyama | 123/184.42 |
| 7,789,066 | B2 * | 9/2010 | Torii et al. | 123/336 |
| 2007/0028891 | A1 * | 2/2007 | Akagawa | 123/336 |
| 2007/0144483 | A1 | 6/2007 | Torii et al. | |
| 2008/0110430 | A1 | 5/2008 | Ogawa et al. | |
| 2009/0050098 | A1 | 2/2009 | Sano et al. | |

FOREIGN PATENT DOCUMENTS

| | | | |
|---|---|---|---|
| JP | 4-57665 | U | 5/1992 |
| JP | 2006-233907 | A | 9/2006 |
| JP | 2008-64163 | A | 3/2008 |
| JP | 2009-52460 | A | 3/2009 |

OTHER PUBLICATIONS

European Search Report issued Aug. 19, 2009 in corresponding European Patent Application No. 09008081.3.
Japanese Office Action issued Jan. 24, 2012 by the Japanese Patent Office in Japanese Patent Application No. 2008-162961 and its English language translation.

* cited by examiner

*Primary Examiner* — Noah Kamen
(74) *Attorney, Agent, or Firm* — Buchanan Ingersoll & Rooney PC

(57) ABSTRACT

An air intake apparatus for an internal combustion engine includes an intake manifold adapted for being connected to an engine head, the intake manifold including therein an intake passage through which a stream of fuel-air mixture passes and a receiving portion formed at an inner circumferential surface of the intake passage, the receiving portion being at a downstream side of stream of fuel-air mixture; a valve open/close mechanism including a cartridge made of resin, an open/close valve accommodated in the cartridge, and a shaft for rotating the open/close valve, the cartridge defining a first clearance with the receiving portion and defining a second clearance with the engine head; and a first elastic member arranged between the engine head and the cartridge of the valve opening/closing mechanism for elastically retaining the cartridge in an upstream direction of the stream of fuel-air mixture.

13 Claims, 4 Drawing Sheets

AIR INTAKE APPARATUS FOR INTERNAL COMBUSTION ENGINE

CROSS REFERENCE TO RELATED APPLICATIONS

This application is based on and claims priority under 35 U.S.C. §119 to Japanese Patent Application 2008-162961, filed on Jun. 23, 2008, the entire content of which is incorporated herein by reference.

FIELD OF THE INVENTION

The present invention relates to an air intake apparatus for an internal combustion engine.

BACKGROUND

From a perspective of a weight reduction of a petrol engine for a vehicle and from a perspective of increases of thermal insulating properties and design flexibility of the petrol engine, an intake manifold distributing air sucked by the engine into cylinders has been mainly made of resin instead of metal such as aluminum alloy in recent years. However, when a resin is applied as a material of the intake manifold, the form accuracy tends to deteriorate because warpage or shrinkage of the resin is unavoidable, compared to an intake manifold made of metal.

For example, a four-cylinder engine includes an intake manifold having four air intake passages. Further, the air intake manifold includes an air intake apparatus controlling an air intake volume and a flow rate or direction of air sucked into the air intake passages when needed. The air intake apparatus includes open/close valves opened and closed by a shaft in the respective air intake passages in accordance with rotation of the shaft. Opening of the open/close valve is controlled by an actuator so that an appropriate combustion condition is obtained depending on driving states of a vehicle.

For example, an air intake apparatus for an internal combustion engine described in JP2006-233907A (hereinafter referred to as Patent document 1) includes a plurality of resin control units serving as a valve opening/closing mechanism. Each of the control units is arranged in a receiving portion of an intake manifold attached to a cylinder head, thereby opening and closing each air intake passage of the intake manifold. The control unit includes a housing (cartridge) and an open/close valve rotatably supported in the housing. The housing of the control unit is inserted in the receiving portion of the intake manifold while having a predetermined clearance defined between an outer surface of the housing and the receiving portion. Accordingly, the housing is retained to the intake manifold via elastic members.

However, according to the Patent document 1, when the intake manifold is expanded due to heat or deformed due to a dimensional change caused by water absorption, the housing of the control unit is deformed via the elastic members. Accordingly, the housing may be cracked and damaged due to stress generated by the deformation of the control unit. When the housing is deformed, scoring or scratches of the open/close valve arranged in the housing occurs, so hat a bearing of the shaft is not precisely aligned to a desired position. Consequently, when the open/close valve is opened and closed by the shaft in accordance with the rotation of the shaft, a slide resistance of the open/close valve and abrasions of the bearing may incase. Moreover, when a clearance between the housing and the open/close valve is increased, a seal performance of the open/close valve may deteriorate when the open/close valve is in a fully closed state.

In addition, when the cylinder head and the housing make contact with each other, stress is generated in the housing. Accordingly, the housing may be cracked and damaged. Additionally, when a clearance for preventing the stress is established between the cylinder head and the housing, the housing is moved in the clearance during an activation of the engine. As a result, an abnormal noise may occur and durability of the control unit may deteriorate.

A need thus exists for an air intake apparatus for an internal combustion engine, which is not susceptible to the drawback mentioned above.

SUMMARY OF THE INVENTION

According to an aspect of the present invention, an air intake apparatus for an internal combustion engine includes an intake manifold adapted for being connected to an engine head, the intake manifold including therein an intake passage through which a stream of fuel-air mixture passes and a receiving portion formed at an inner circumferential surface of the intake passage, the receiving portion being at a downstream side of the stream of fuel-air mixture; a valve open/close mechanism including a cartridge made of resin, an open/close valve accommodated in the cartridge, and a shaft for rotating the open/close valve, the cartridge defining a first clearance with the receiving portion and defining a second clearance with the engine head; and a first elastic member arranged between the engine head and the cartridge of the valve opening/closing mechanism for elastically retaining the cartridge in an upstream direction of the stream of fuel-air mixture.

BRIEF DESCRIPTION OF THE DRAWINGS

The foregoing and additional features and characteristics of the present invention will become more apparent from the following detailed description considered with the reference to the accompanying drawings, wherein.

DETAILED DESCRIPTION

Figure 1:
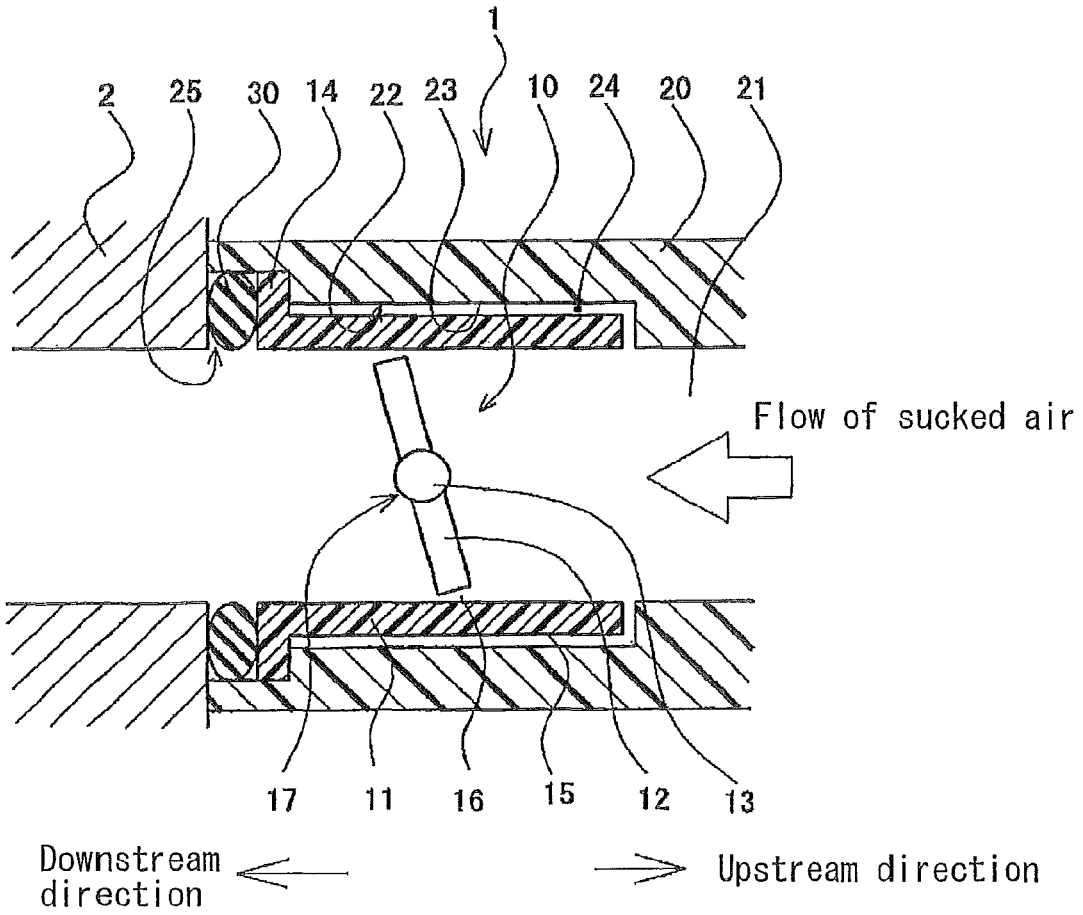
FIG. 1 is an enlarged cross-sectional view of an air intake apparatus for an internal combustion engine according to a first embodiment of the present invention.

Embodiments of the present invention will be explained with reference to the illustrations of the figures as follows. FIG. 1 is an exploded cross-sectional view of an air intake apparatus 1 for an internal combustion engine according to a first embodiment. The air intake apparatus 1 includes a valve opening/closing mechanism 10, an intake manifold 20, and an elastic member (fist elastic member) 30. The valve opening/closing mechanism 10 is arranged within the intake manifold 20. Further, the valve opening/closing mechanism 10 includes a cartridge 11 made of resin, an open/close valve 12 arranged within the cartridge 11, and a shaft 13 rotating the open/close valve 12 to open and close. The cartridge 11 includes a flange 14. The intake manifold 20 is attached to an engine head 2 with a fastening member such as a bolt. The intake manifold 20 includes an air intake passage 21 and a receiving portion 22. The intake manifold 20 is attached to the engine head 2. The intake manifold 20 includes the receiving portion 22 in an inner circumferential surface of the air intake passage 21 in a downstream direction of a flow of air sucked into the air intake passage 21 of the intake manifold 20. The elastic member 30 is arranged between the engine head 2 and the cartridge 11 of the valve opening/closing mechanism 10. The elastic member 30 elastically retains the flange 14 of the cartridge 11 in an upstream direction of the flow of the sucked air in the air intake passage 21 of the intake manifold 20. An approximately 1-millimeter clearance (first clearance) 24 is established between an outer circumferential surface 15 of the cartridge 11 and an inner circumferential surface 23 of the receiving portion 22. An approximately 3-millimeter clearance (second clearance) 25 is established between the engine head 2 and the flange 14.

When an engine is activated, air for combustion of the engine is sucked into the intake manifold 20 and flows from the upstream direction to the downstream direction of the sucked air in the air intake passage 21. At this time, the shaft 13 is rotated in response to a signal transmitted from an engine control unit, thereby opening and closing the open/close valve 12 of the valve opening/closing mechanism 10. Accordingly, the flow of the sucked air is controlled. The intake manifold 20 and the engine head 2 are deformed due to thermal expansion or the like in accordance with the activation (combustion) of the engine. However, the deformation of the intake manifold 20 is tolerated by means of the clearance 24. In addition, the deformation of the engine head 2 is tolerated by the elastic member 30 arranged in the clearance 25. Accordingly, the valve opening/closing mechanism 10 is free from being deformed.

In the air intake apparatus 1 of the first embodiment, the clearance 24 by which the deformation of the intake manifold 20 is tolerated, is arranged between the outer circumferential surface 15 of the cartridge 11 and the inner circumferential surface 23 of the receiving portion 22. Further, the clearance 25 is arranged between the engine head 2 and the flange 14. The flange 14 is elastically retained by the elastic member 30 in the upstream direction of the flow of the sucked air in the air intake passage 21, so that the deformation of the intake manifold 20 is tolerated by means of the clearance 24. Accordingly, a clearance 16 defined between the cartridge 11 and the open/close valve 12 and a bearing 17 of the shaft 13 are not affected by the deformation of the intake manifold 20. Consequently, scoring or scratches of the open/close valve 12 is prevented. Further, a slide resistance of the shaft 13 opening and closing the open/close valve 12 and abrasions of the bearing 17 of the shaft 13 are prevented from increasing. Thus, an appropriate seal performance of the open/close valve 12 is obtained when the open/close valve 12 is opened and closed. In addition, the deformation of the engine head 2 is tolerated by an elastic force of the elastic member 30 arranged in the clearance 25, so that the flange 14 does not make contact with the engine head 2. Accordingly, an excessive stress is prevented from acting on the flange 14. Consequently, the flange 14 is prevented from being cracked and damaged. Moreover, the flange 14 is elastically retained in the upstream direction of the flow of the sucked air in the air intake passage 21, thereby being prevented from moving in the clearance 25 during the activation of the engine. Consequently, the occurrence of an abnormal noise during the activation of the engine is reduced. As a result, the endurance of the valve opening/closing mechanism 10 is prevented from deteriorating.

Figure 2:
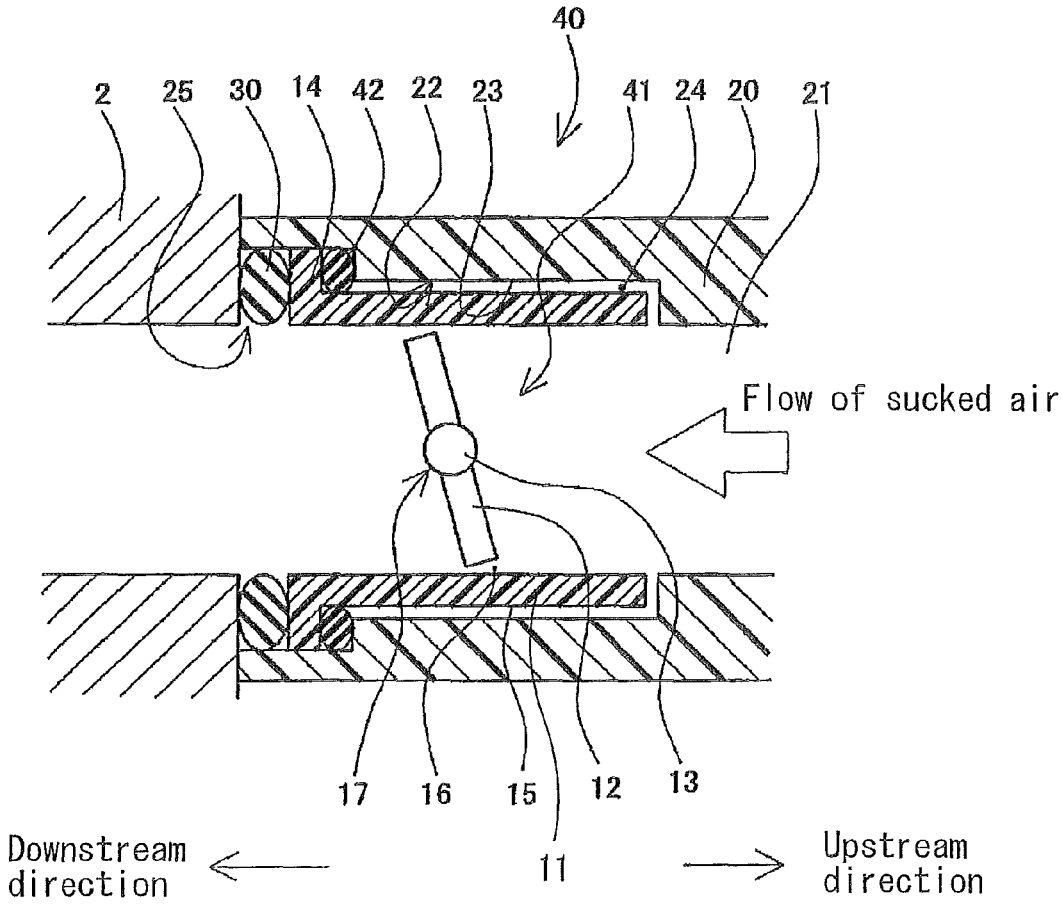
FIG. 2 is an enlarged cross-sectional view of an air intake apparatus for an internal combustion engine according to a second embodiment of the present invention.

FIG. 2 is an enlarged cross-sectional view of an air intake apparatus 40 for the internal combustion engine according to a second embodiment. In the second embodiment, same numbers are assigned to members having similar portions and functions similar to those of the first embodiment. A main different configuration and effects due to the configuration will be described as follows.

The air intake apparatus 40 according to the second embodiment is different from the air intake apparatus 1 of the first embodiment in that an elastic member (second elastic member) 42 is arranged between the flange 14 of a valve opening/closing mechanism 41 and the intake manifold 20. The elastic member 42 elastically retains the flange 14 in the downstream direction of the flow of the sucked air in the air intake passage 21. Other configurations are the same as the configurations of the valve opening/closing mechanism 10 of the first embodiment.

In addition to the effects of the first embodiment, both surfaces (located in the upstream and downstream directions of the flow of the sucked air in the air intake passage 21) of the flange 14 are elastically retained by the elastic member 30 and the elastic member 42 in the air intake apparatus 40. Accordingly, even when the engine head 2 and the intake manifold 20 are deformed, the deformation does not affect the valve opening/closing mechanism 41 because the elastic member 30 is arranged between the engine head 2 and the cartridge 11 and the elastic member 42 is arranged between the intake manifold 20 and the cartridge 11. Consequently, an operational failure of the valve opening/closing mechanism 41 may be prevented.

Figure 3:
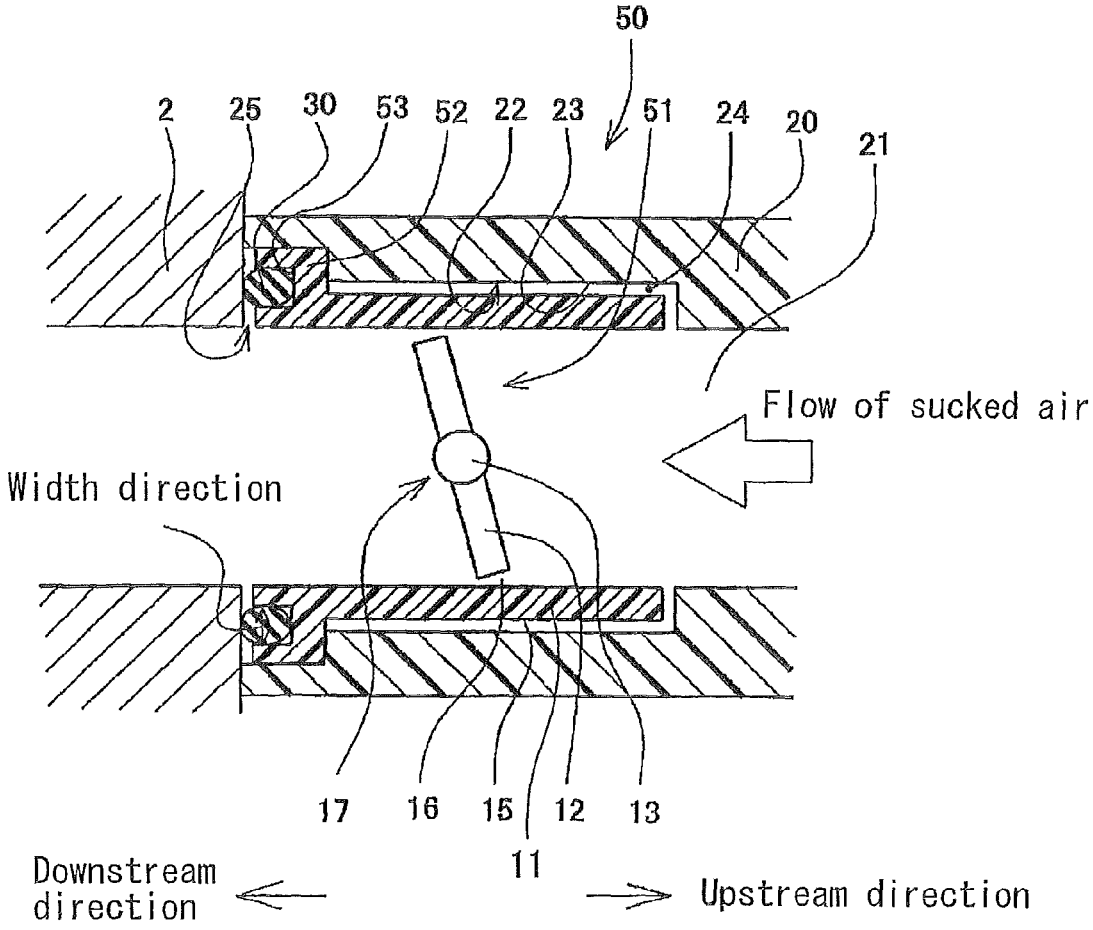
FIG. 3 is an enlarged cross-sectional view of an air intake apparatus for an internal combustion engine according to a third embodiment of the present invention.

FIG. 3 is an enlarged cross-sectional view of an air intake apparatus 50 for the internal combustion engine according to a third embodiment. In the third embodiment, same numbers are assigned to members having similar portions and functions to those of the first embodiment. A main different configuration and effects according to the configuration will be described as follows.

The air intake apparatus 50 according to the third embodiment is different from the air intake apparatus 1 of the first embodiment in that a an annular groove 53 is formed in a flange 52 of a valve opening/closing mechanism 51 in the air intake apparatus 50 and that the elastic member 30 in the form of an O-ring are arranged in the groove 53. Other configurations are the same as the configurations of the valve opening/closing mechanism 10 of the first embodiment. The groove 53 is opposition to the engine head 2. The elastic member or O-ring 30 is larger than the groove 53 in width such that when the elastic member 30 is fitted in the groove 53 the elastic member 30 is under compression and protrudes from the groove 53 to be in fluid-tight engagement with the engine head 2.

The air intake apparatus 50 according to the third embodiment is different from the air intake apparatus 1 of the first embodiment in that a an annular groove 53 is formed in a flange 52 of a valve opening/closing mechanism 51 in the air intake apparatus 50 and that the elastic member 30 in the form of an O-ring are arranged in the groove 53. Other configurations are the same as the configurations of the valve opening/closing mechanism 10 of the first embodiment. The groove 53 is opposition to the engine head 2. The elastic member or O-ring 30 is larger than the groove 53 in width such that when the elastic member 30 is fitted in the groove 53 the elastic member 30 is under compression and protrudes from the groove 53 to be in fluid-tight engagement with the engine head 2.

In addition to the effects of the first embodiment, the deformation of the elastic member 30 in the width direction (vertical direction as seen in FIG. 3) is limited by the groove 53. Accordingly, an elastic force of the elastic member 30 in the downstream direction of the flow of the sucked air in the air intake passage 21 increases, so that the elastic member 30 is effectively compressed. In addition, when the intake manifold 20 is assembled on the engine head 2, the elastic member 30 is prevented from protruding from the groove 53 of the flange 52. Accordingly, an increase of a flow resistance of the sucked air in the intake manifold 20 due to the assembling failure between the intake manifold 20 and the engine head 2 and the protrusion of the elastic member 30 from the groove 53 of the flange 52 is reduced.

Although the case where the elastic member 30 is arranged in the groove 53 formed in the flange 52 is described in the third embodiment, a groove may be arranged in a surface of the flange 52, which located in the upstream direction of the flow of the sucked air in the air intake passage 21.

Figure 4:
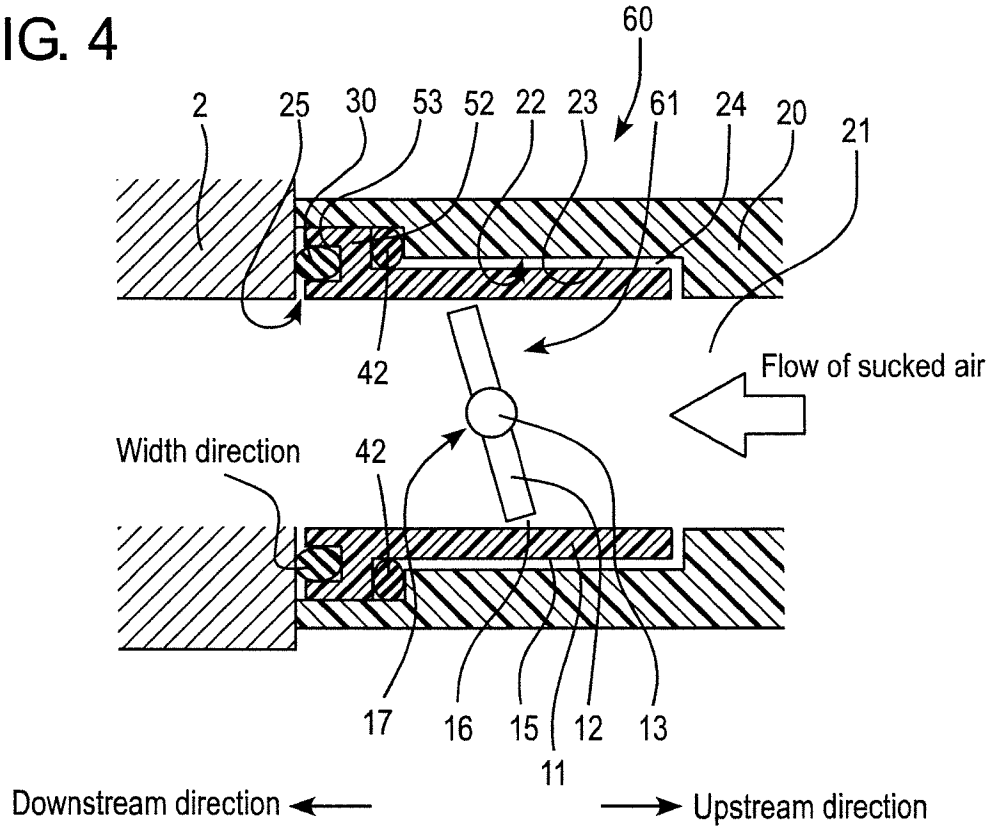
FIG. 4 is an enlarged cross-sectional view of an air intake apparatus for an internal combustion engine according to a fourth embodiment of the present invention.

The air intake apparatus 60 according to the fourth embodiment illustrated in FIG. 4 includes a second elastic member 42 arranged between a flange 52 of a valve opening/closing mechanism 61 and the intake manifold 20, and an annular groove 53 formed in the flange 52 in which the elastic member 30 is arranged.

As described in the aforementioned embodiments, the deformation of the intake manifold 20 is tolerated by means of the clearance 24, thereby not affecting the clearance 16 between the cartridge 11 and the open/close valve 12 and the bearing 17 of the shaft 13. Accordingly, when the open/close valve 12 is opened and closed in accordance with rotation of the shaft 13, a slide resistance of the shaft 13 and abrasions of the bearing 17 of the shaft 13 are prevented from increasing. Consequently, an appropriate seal performance of the open/close valve 12 is obtained when the open/close valve 12 is in a fully closed state. Moreover, the deformation of the engine head 2 is tolerated by an elastic force of the elastic member 30, so that the engine head 2 and the cartridge 11 do not make contact with each other. Further, an excessive stress due to the deformation of the engine head 2 is prevented from acting on the cartridge 11. Consequently, the occurrence of cracks and damage of the cartridge 11 is prevented. In addition, since the cartridge 11 is elastically retained by the elastic member 30 in the upstream direction of the sucked air in the air intake passage 21, the cartridge 11 is prevented from moving in the clearance 25 during the activation of the engine. Thus, the occurrence of an abnormal noise is prevented and the durability of the valve opening/closing mechanism 10, 41, 51 may be prevented from deteriorating.

According to the aforementioned embodiments, the cartridge 11 includes the flange 14, 52 and the second clearance 25 is established between the engine head 2 and the flange 14, 52. Moreover, the first elastic member 30 elastically retains the flange 14, 52 in the upstream direction of the flow of the sucked air in the air intake passage 21.

Accordingly, the engine head 2 and the flange 14, 52 do not make contact with each other, so that an excessive stress due to the deformation of the engine head 2 is prevented from acting on the flange 14, 52. Consequently, the occurrence of cracks and damage of the flange 14, 52 may be prevented. Moreover, the flange 14, 52 is prevented from moving in the clearance 25 during the activation of the engine. As a result, the occurrence of an abnormal noise is reduced, so that the durability of the valve opening/closing mechanism 10, 41, 51 may be prevented from deteriorating.

According to the aforementioned embodiments, the second elastic member 42 is arranged between the flange 14 and the intake manifold 20. The second elastic member 42 elastically retains the flange 14 in the downstream direction of the flow of the sucked air in the air intake passage 21.

Accordingly, the both surfaces (located in the upstream and downstream directions of the flow of the sucked air in the air intake passage 21) of the flange 14 are elastically retained by the elastic member 30 and the elastic member 42. Even when the engine head 2 and the intake manifold 20 are deformed, the above-mentioned deformation does not affect the valve opening/closing mechanism 41 because the elastic member 30 is arranged between the engine head 2 and the cartridge 11 and the elastic member 42 is arranged between the intake manifold 20 and the cartridge 11. Consequently, the operating failure of the valve opening/closing mechanism 41 may be prevented.

According to the aforementioned embodiments, the groove 53 is formed in the flange 52, and at least one of the first elastic member 30 and the second elastic member 42 is arranged in the groove 53 of the flange 52.

Accordingly, the deformation of the elastic member 30 or the elastic member 42 in the width direction is limited by the groove 53. Consequently, an elastic force in the downstream direction or the upstream direction of the sucked air in the air intake passage 21 increases, compared to the case where the elastic member 30 is arranged on a surface of the flange 14. As a result, the elastic member 30 or the elastic member 42 may be effectively compressed. In addition, when the intake manifold 20 is assembled on the engine head 2, the elastic member 30 or the elastic member 42 may be prevented from protruding from the groove 53 of the flange 52. Thus, an increase of a flow resistance of the sucked air in the air intake passage 21 due to the assembling failure between the engine head 2 and the intake manifold 20 and the protrusion of the elastic member 30 or the elastic member 42 from the groove 53 of the flange 52 is reduced.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An air intake apparatus for an internal combustion engine, comprising:

an intake manifold adapted for being connected to an engine head, the intake manifold including therein an intake passage through which a stream of fuel-air mixture passes and a receiving portion formed at an inner circumferential surface of the intake passage, the receiving portion being at a downstream side of the stream of fuel-air mixture;

a valve open/close mechanism including a cartridge made of resin, an open/close valve accommodated in the cartridge, and a shaft for rotating the open/close valve, the cartridge defining a first clearance with the receiving portion and defining a second clearance with the engine head; and a first elastic member arranged between the engine head and the cartridge of the valve opening/closing mechanism for elastically retaining the cartridge in an upstream direction of the stream of fuel-air mixture, wherein the cartridge is provided with a flange which defines the second clearance in which the first elastic member is fitted with the engine head, wherein the apparatus further comprises a second elastic member arranged between the flange and the intake manifold for elastically retaining the flange in a downstream direction of the stream of fuel-air mixture, and wherein the flange is provided therein with a groove in which at least one of the first elastic member and the second elastic member is fitted.

2. The air intake apparatus according to claim 1, wherein the first elastic member is formed as a separation element from the cartridge.

3. The air intake apparatus according to claim 1, wherein the first elastic member and the second elastic member are formed as a separate element from the cartridge.

4. The air intake apparatus according to claim 1, wherein the groove opens to the engine head.

5. The air intake apparatus according to claim 1, wherein the groove is an annular groove.

6. The air intake apparatus according to claim 5, wherein the annular groove opens to the engine head, and the first elastic member is fitted in the annular groove.

7. The air intake apparatus according to claim 1, wherein the first elastic member is an O-ring.

8. The air intake apparatus according to claim 1, wherein the first elastic member is fitted into the groove under compression and protruding from the groove to be in fluid-tight engagement with the engine head.

9. An air intake apparatus for an internal combustion engine, comprising:

an intake manifold configured for connection to an engine head of the internal combustion engine, with an intake passage passing through the intake manifold and through which passes a stream of fuel-air mixture during operation of the internal combustion engine;

a receiving portion at an inner circumferential surface of the intake passage;

a valve open/close mechanism comprising; a resin cartridge mounted in the receiving portion; an open/close valve accommodated in the cartridge; and a shaft connected to the open/close valve for rotating the open/close valve;

the cartridge having an outer peripheral surface facing an inner surface of the receiving portion, an end surface of the cartridge facing an opposing surface of the engine head;

the cartridge being positioned in the receiving portion so that a first clearance exists between the outer peripheral surface of the cartridge and the inner surface of the receiving portion, and so that a second clearance exists between the end surface of the cartridge and the opposing surface of the engine head; and a first elastic member contacting the opposing surface of the engine head and the end surface of the cartridge for elastically retaining the cartridge in an upstream direction of the stream of fuel-air mixture, wherein the cartridge includes a flange having a surface that is the end surface of the cartridge, wherein the apparatus further comprises a second elastic member arranged between the flange and the intake manifold for elastically retaining the flange in a downstream direction of the stream of fuel-air mixture, and wherein the flange includes a groove in which at least one of the first elastic member and the second elastic member is positioned.

10. The air intake apparatus according to claim 9, wherein the first elastic member and the second elastic member are separate from the cartridge.

11. The air intake apparatus according to claim 9, wherein the groove is an annular groove.

12. The air intake apparatus according to claim 9, further comprising a second elastic member arranged between the cartridge and the intake manifold for elastically retaining the flange in a downstream direction of the stream of fuel-air mixture, wherein the first and second elastic members are positioned so that a portion of the cartridge is located between the first and second elastic members.

13. The air intake apparatus according to claim 9, wherein the first elastic member is positioned in the groove under compression and protrudes outside the groove in fluid-tight engagement with the engine head.

* * * * *